US005809842A

United States Patent [19]

Yamagiwa et al.

[11] Patent Number: 5,809,842

[45] Date of Patent: Sep. 22, 1998

[54] CERAMIC SLIDING COMPONENT

[75] Inventors: Masamichi Yamagiwa; Takao Nishioka; Hisao Takeuchi; Akira Yamakawa, all of Hyogo, Japan

[73] Assignee: Sumitomo Electric Industries, Ltd., Japan

[21] Appl. No.: 718,588

[22] PCT Filed: Jun. 21, 1996

[86] PCT No.: PCT/JP96/01727

§ 371 Date: Sep. 26, 1996

§ 102(e) Date: Sep. 26, 1996

[87] PCT Pub. No.: WO97/01696

PCT Pub. Date: Jan. 16, 1997

[30] Foreign Application Priority Data

Jun. 26, 1995 [JP] Japan ..... 7-159407

[51] Int. Cl.[6] ..... F16H 53/06

[52] U.S. Cl. ..... 74/569; 123/90.51; 123/90.35

[58] Field of Search ..... 123/90.33, 90.35, 123/90.51; 74/569

[56] References Cited

U.S. PATENT DOCUMENTS

| | | | |
|---|---|---|---|
| 3,124,869 | 3/1964 | Behnke et al. | 29/888.03 |
| 3,683,876 | 8/1972 | Lesher | 123/90.35 |
| 3,875,911 | 4/1975 | Joseph | 123/90.35 |
| 4,508,067 | 4/1985 | Fuhrmann | 123/90.51 |
| 4,632,074 | 12/1986 | Takahashi et al. | 123/188.3 |
| 5,035,959 | 7/1991 | Ito et al. | 123/90.51 |
| 5,185,923 | 2/1993 | Taniguchi et al. | 29/888.46 |

FOREIGN PATENT DOCUMENTS

| | | | |
|---|---|---|---|
| 0 080 175 | 6/1983 | European Pat. Off. | 123/90.51 |
| 1020632 | 2/1953 | France | 123/90.51 |
| 63-225728 | 9/1988 | Japan . | |
| 220703 | 2/1990 | Japan . | |
| 255809 | 2/1990 | Japan . | |
| 55809 | 2/1990 | Japan . | |
| 314903 | 11/1992 | Japan . | |
| 5-340213 | 12/1993 | Japan | 29/888.4 |
| 633708 | 2/1994 | Japan . | |
| 610095 | 3/1994 | Japan . | |
| 74811 | 9/1994 | Japan . | |
| 2093554 | 9/1982 | United Kingdom | 123/90.51 |

*Primary Examiner*—Erick R. Solis
*Attorney, Agent, or Firm*—Bierman, Muserlian and Lucas

[57] ABSTRACT

The present invention is intended to provide a sliding member that can prevent abnormal wear and partial wear of the mating metal sliding component even when an oil contaminated with exhaust gas components is used.

A ceramic sliding component is manufactured as followed. A silicon nitride-based material for the sliding face member is joined to a metal body having a higher thermal expansion coefficient than the sliding face member. A crowned portion is formed on the sliding face of the sliding face member in such a way that the difference between the amounts of crowning (da, db) at two arbitrary points axially symmetric with respect to the center line of the crowned portion is 10% or more and 50% or less of the average of the crowning amounts at the two points.

23 Claims, 8 Drawing Sheets

CERAMIC SLIDING COMPONENT

TECHNICAL FIELD

The present invention relates to sliding members used on valve train system components in an automotive engine, sliding members such as cam followers and rocker arms and sliding members installed in hydraulic circuits in the engine and between driving components, and more particularly to sliding members that exhibit their effectiveness when used on tappets having a metal base and a ceramic sliding member joined together and on pistons of hydraulic circuits using the driving system of the engine.

BACKGROUND ART

Mechanical sliding parts, such as represented by automotive engine parts, often have a convex crowning shape on one of the mating sliding parts to prevent uneven wear or uneven contact due to poor alignment. Japan Patent Laid-Open No. 63-225728, for example, discloses a technology, in which a wear resistant member with a smaller thermal expansion coefficient than the metal base is heated and joined to the base metal to form a sliding face which is formed into a crowning shape because of a thermal expansion coefficient difference. This cited patent shows a method of providing a low-cost sliding part that can prevent uneven contact due to poor alignment during sliding motion by providing a crowning shape without resorting to machining such as grinding. The cited patent also discloses that the wear resisting member uses ceramic materials such as silicon nitride, silicon carbide and sialon.

In recent years, global environmental situations make the enforcement of more stringent regulations on automotive emissions an urgent issue and, in diesel engine in particular, studies are under way to reduce nitrogen oxides (NOx) and particulate matters (P/M). One method to comply with this requirement currently being studied is to attach an EGR (exhaust gas recirculation) mechanism to the engine exhaust system to reduce NOx. This method, however, raises problems that recirculation of exhaust gas components chemically degrades the engine oil and that trapped particulate matters contaminate oil, leading to abnormal wear of the engine sliding parts.

To solve these problems, a provision of moderate crowning was proposed but it was not sufficient. In the case where a silicon nitride ceramic material with high wear resistance is used as a sliding face member, for example, if the crowning contour should deform with respect to the center line, the contact face and the contact face pressure during the sliding motion also change, causing uneven wear and fatigue wear such as pitting and fretting to the mated sliding part because the ceramic material has a higher hardness than the metal material of the mated sliding part.

The center line referred to here is a rotating axis about which the sliding part turns during operation.

The present invention is intended to provide a ceramic sliding component that has a crowning geometry or profile that will not cause uneven wear or fatigue wear.

DISCLOSURE OF THE INVENTION

The constitution of this invention that solves the above-mentioned problems is the sliding component as defined in the claims. In a sliding component in which a silicon nitride-based material as the sliding face member and a metal body with a greater thermal expansion coefficient than the sliding face member are joined together and in which the sliding face is formed into a shape of crown, the difference in the amount of crowning between two points that are axially symmetric with respect to the center line of the crowning contour is 10% or more and 50% or less with respect to an average value of the crowning at the two points. This will be explained taking an example case of a tappet in the diesel OHV engine shown in FIG. 1.

FIG. 1 shows a basic construction of a tappet, in which a sliding face member 1 made of silicon nitride-based material is rotated about the center line of the crowning contour of the sliding face member by a rotating force applied by a mating cam 2 that slides, offset by a specified amount, on the sliding face member thereby preventing uneven wear or uneven contact due to poor alignment. Further, FIG. 2 shows an enlarged view of the sliding face. This invention requires that in FIG. 2 the absolute value of a difference (da−db) between the amounts of crowning da and db at two arbitrary points A and B that are axially symmetrical with respect to the central line of the crowning contour meet the relationship of the following equation (1) with respect to the average of the crowning amounts at two points (da+db)/2.

$$10(\%) \leqq \left[ \frac{|da - db|}{\left\{ \frac{da + db}{2} \right\}} \right] \times 100(\%) \leqq 50(\%) \qquad \text{Equation (1)}$$

Here, when in equation (1) the value in question exceeds 50%, undesirable conditions occur, i.e., uneven wear and pitting and fretting wear occur on the cam face because of variations in the contact condition with the cam face, the contact area and the contact face pressure during rotation. To keep the value less than 10%, however, requires an improved joining precision (in the case of ordinary braze joining, the precision may be improved by making the thickness of a brazing filler uniform) and a special machining (e.g., NC cutting by a contouring diamond grinding wheel to which a crowning contour precision is transferred) to secure a crowning contour precision in terms of deviation. This, however, increases manufacture cost, which is economically undesirable. This increased manufacture cost is not accompanied with a corresponding significant improvement in the wear resistance of the mating metallic sliding member, resulting in a degraded cost performance.

Because the sliding components have severe lubrication requirements, a lubricant needs to be supplied to the sliding portion and in some cases oil holes 4 may have to be formed near the joint face as shown in FIG. 3. The formation of oil holes in the metal body causes a local change in the rigidity at that location, which in turn deforms the crowning. It is therefore desired that the oil holes be formed in such a way that the oil hole diameter d and the number of oil holes n ($n \geqq 1$) meet the following conditions:

1. $d^2 \times n/D = 0.07$ to 1.4, where D is a diameter of the metal body;
2. $d^2 \times n/L = 0.05$ to 1.05, where L is an overall length of the metal body;
3. $d^2 \times n/W = 1.3$ to 26, where W is a minimum thickness of the metal body where the oil hole is formed;
4. $d^2 \times n/t = 1$ to 20, where t is a thickness of the sliding member joined; and
5. $d^2 \times n/A = 0.2$ to 4.2, where A is a distance from the joined face of the metal body to the center of the oil hole.

When the value is below the lower limit of the allowable range, the diameter of the oil holes becomes so small making it difficult for the viscous lubricating oil to flow through, leaving the sliding portions unlubricated, causing wear or seizure to the metal body and the sliding member. Further, reduced diameter of the oil holes makes the drilling difficult, raising the manufacture cost. When the value exceeds the upper limit, the oil hole diameter becomes large, locally changing the rigidity of the metal body and deforming the crowning, which in turn degrades the dimensional precision resulting in partial or uneven wear of the mating sliding metal component. The hole diameter and the number of oil holes should be chosen in the range specified by this invention according to the situation. When one wishes to increase the size of the oil hole, this can be achieved by setting the value close to the upper limit or reducing the number of holes. It is noted, however, that reducing the hole diameter to increase the number of holes is not desirable even if this is within the allowable range, because an increase in the number of processing steps in machining the holes increases the manufacture cost.

Although the drilling of the oil holes may be performed either before or after the sliding face member is joined as long as the axial symmetry precision is within the allowable range defined by this invention, the holes should preferably be made before the joining process because hole forming after the joining process locally changes the rigidity of the joined body that was balanced during the joining, and the effect of drilling after the joining is greater than before the joining.

When two or more oil holes 4 are formed, all of these are preferably equidistant from the joined face 5 between the sliding face member 1 and the metal body 3. But if the crowning precision is not affected, they may not be equal in distance. The oil hole diameters also may not be the same if the diameter difference does not influence the crowning precision. From the manufacturing standpoint, however, they are preferably equal.

The present invention is realized by the construction which is symmetric two or more times with respect to the direction of diameter of the sliding face. Because the crowning is formed by the balance in rigidity between the metal body and the sliding member joined together, poor or disturbed symmetry will result in deformation of the crowning.

Hence, two or more oil holes should preferably be formed to keep the symmetry of the metal body.

The hole diameter and the number of holes need only be within the range specified by this invention.

When the piston of the hydraulic circuit and the tappet are shaped like a mushroom as shown in FIG. 4, it is preferred that the dimensional ratio D2/D1 between the diameter (D2) of a slider portion 6 of the metal body 8 and the diameter (D1) of an umbrella portion 7 be set at 0.5 or higher and that the dimensional ratio D2/A2 between the diameter (D2) of the slider portion and the maximum thickness (A2) of the umbrella portion be set at 6.5 or higher. When D2/D1 is less than 0.5, the projection of the umbrella portion of the metal body becomes large and the deformation large so that the crowning does not stabilize and the required precision of axial symmetry cannot be maintained. This dimensional ratio is further preferred to exceed 0.625 but because the metal body has a mushroom contour, the upper limit is less than 1. When D2/A2 is less than 6.5, the diameter of the slider portion becomes small causing the umbrella projection to increase as in the preceding case, which is not desirable. The maximum thickness of the umbrella portion means the distance from the joined face of the sliding face member to a point where the umbrella portion has the same diameter as the slider portion.

The slider portion needs to have an appropriate length (L1) for its sliding function. If the slider portion length is less than 10 times the maximum thickness of the umbrella portion (A2), the rigidity of the metal body is small and the deformation large, which is not preferable.

While the shape of the section joining the umbrella portion and the slider portion differs according to the condition of use of the sliding component, it may be flat or tapered as shown in FIGS. 5A and 5B. With a piston that uses the umbrella portion as a stopper, the joining portion needs to be flat as shown in FIG. 5A. With a tappet that does not need to have a flat joining portion, it may be tapered as shown in FIG. 5B.

If the sliding face member is less than 1 mm in thickness (Al), impacts applied to the sliding face during the sliding motion may exceed the impact strength of the sliding face member, leading to fracture.

To avoid producing local changes in rigidity and obtain a stable deformation, it is preferred that the metal body 8 be made of a single material without any joining such as welding or pressure welding for the following reasons.

a. In the case where split metal bodies are joined together before the sliding face member is joined, if the joining between the metal bodies becomes nonuniform, the brazing the sliding face member to the metal body will result in partially uneven thermal expansion/contraction of the metal body, causing a partial deformation of the crowning. Strains caused during the joining of the metal bodies are released during brazing. Because the strains are not uniform according to locations, the crowning is partially deformed.

b. In the case where the split metal bodies are joined after the sliding face member is joined, the strains that occur when the lower half of the metal body is joined become uneven, thereby partly deforming the crowning.

c. In the case where different materials are joined together, particularly when the sliding face member is joined after the joining of the metal bodies, the difference in thermal expansion coefficient between the different materials held together makes the thermal expansion/contraction of the metal body partially nonuniform during brazing, which in turn deforms the crowning.

As described above, although the use of split metal bodies makes the machining of the metal body easy and reduces the manufacture cost, it fails to produce characteristics required of the sliding member.

Why a silicon nitride-based material is chosen for the sliding face member is because of the following three reasons: that compared with other structural ceramic materials such as silicon carbide, aluminum oxide (alumina) and zirconium oxide (zirconia), (1) it has a small thermal expansion coefficient that allows a relatively large crowning to be formed stably during the joining process, (2) it has a relatively great strength, which prevents the development of cracks during or after the joining process that would otherwise be caused by tensile stresses in the crowning, and which provides a sufficient durability, and (3) it has a relatively high hardness and an excellent wear resistance. Among these points, the strength characteristic is of great importance. The use of silicon nitride-based material which has a 3-point flexural strength, in accordance with JIS R1601, of 980 MPa or higher or preferably 1274 MPa or higher solves the above-mentioned problems and therefore expands the freedom of design of the crowning contour (mainly in terms of the amount of crowning and the thickness of the sliding silicon nitride-based member).

In addition to the drilling of holes as described above, there is another method that can provide a low-cost crowning with a sufficient precision of axial symmetry. This involves, as shown in FIG. 1, joining to the sliding face member 1 made of a silicon nitride-based material and a metal body having a greater thermal expansion coefficient than the sliding face member, preliminarily forming on the sliding face a base crowning through the thermal expansion difference during the joining process, and grinding the crowning to a desired shape or polishing it with abrasive machining, thereby finishing the crowning to an accuracy defined by the equation (1). When these methods are used, it is preferred that the amount of machining with respect to the center line of the crowning be 20% or less of the maximum crowning amount (which corresponds to "dmax" in FIG. 2). When 20% is exceeded, the machining cost sharply increases, which is economically undesirable. In this case, it is necessary to set the contour precision level of the crowning base close to the final desired level in the first joining process. The metal body, though not limited to any particular material, may typically use JIS SCr, SCM, SNCM steels and so on.

Further, an additional preferred condition to realize the functions and features of this invention is that the surface roughness of the sliding face of the sliding member is 0.4 $\mu$m or less in the 10-point mean roughness defined by JIS. This is because, when this value of 0.4 is exceeded, there is a possibility of the mating sliding cam face being worn out.

As explained in the foregoing, the application of this invention to sliding components, particularly to a tappet of OHV system, can significantly minimize uneven wear of the ceramic sliding face and the cam face. When this invention is applied to a diesel engine with an EGR mechanism, in particular, the component life can be extended substantially.

BRIEF DESCRIPTION OF THE DRAWINGS

FIG. 8A is a front view and FIG. 8B is a side view);

Description of Reference Numerals

1: Sliding face member

2: Cam

3: Metal body

4: Oil hole

5: Joined face

6: Slider portion

7: Umbrella portion

8: Metal body

9: Sliding portion on the outer periphery of the metal body (tappet)

10: Spherically recessed sliding portion at the inner bottom of the metal body (push rod sliding portion)

11: Sliding portion on the outer periphery of the metal body (piston)

12: Piston

13: Engine block

14: Metal body (tappet)

14*a*: Upper half of the metal body

14*b*: Lower half of the metal body

DETAILED DESCRIPTION OF THE PREFERRED EMBODIMENTS

Example 1

Figure 1:
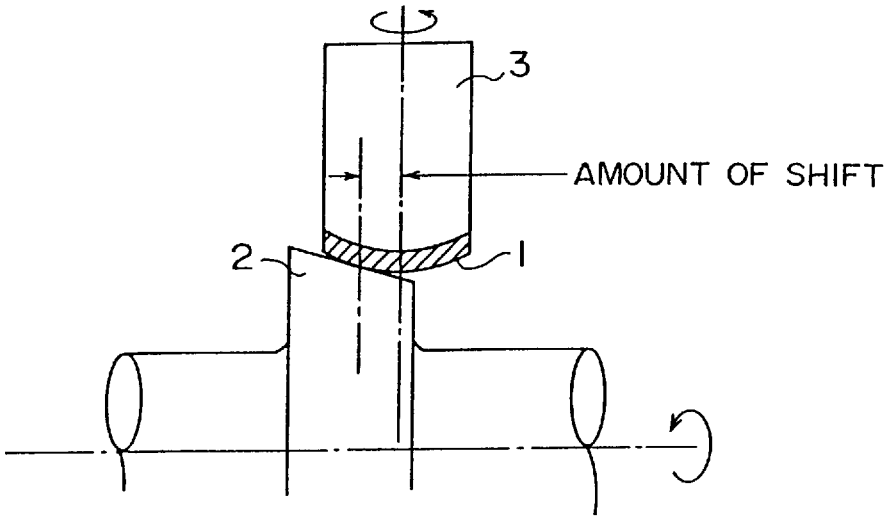
FIG. 1 is a schematic diagram showing a tappet and a cam in OHV valve train system in a diesel engine for a commercial car to which the present invention has been applied.
Figure 2:
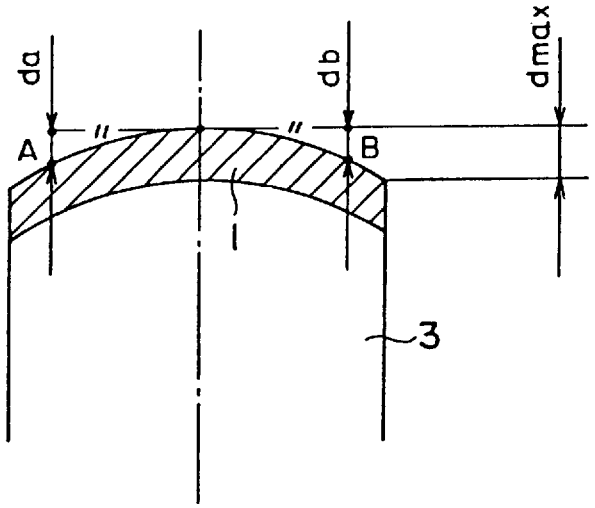
FIG. 2 is a partly enlarged schematic view of a sliding member of the tappet applying this invention.
Figure 3:
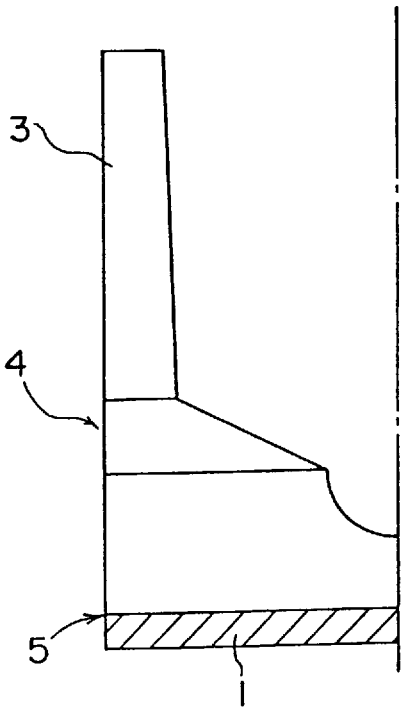
FIG. 3 is a schematic view (cross section) of the tappet applying this invention.
Figure 4:
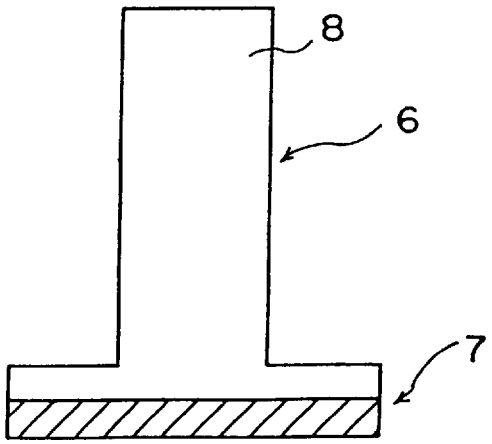
FIG. 4 is a schematic view (cross section) of the piston applying this invention.
Figure 5A:
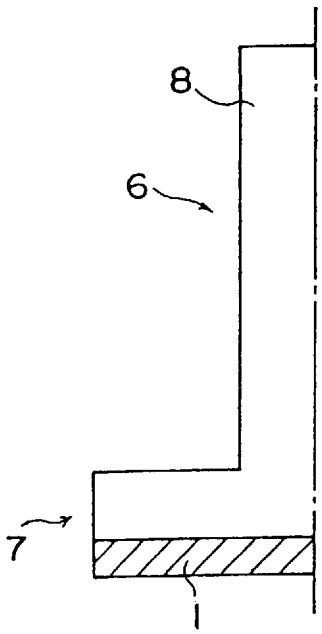
FIGS. 5A and 5B are schematic views (cross sections) of the sliding components applying this invention.
Figure 5B:
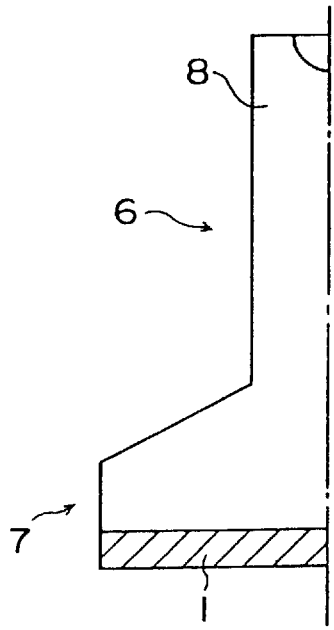
Figure 6:
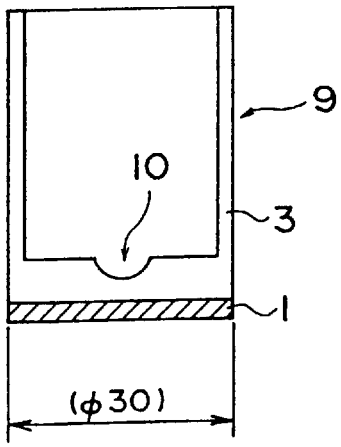
FIG. 6 is a schematic view (cross section) of the tappet applying this invention.
Figure 7:
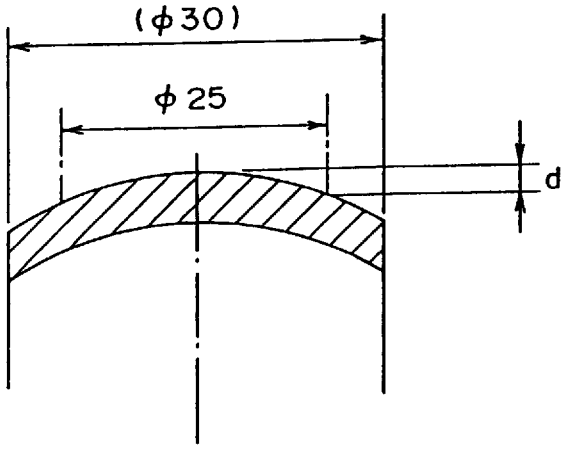
FIG. 7 is a partly enlarged view of the sliding member of the tappet in Examples 1 and 2.

Sintered materials of commonly available silicon nitride, silicon carbide, alumina and zirconia (their 3-point flexural strengths according to JIS R1601 are shown in Table 1) were cut into discs 30 mm in diameter and 1.5–3 mm in thickness. The surface of the cut disc that was to have a sliding contact with the cam was finish-ground to a face roughness of 0.3 $\mu$m or less in the 10-point mean roughness by a diamond grinding wheel with an average abrasive grain size of 7–11 $\mu$m. The sliding face member 1 thus obtained was, as shown in FIG. 6, secured to a metal body 3 shaped as shown in the same figure and made of SCr420, a JIS standard steel, by using various jigs and a brazing material made mainly of Ag. The sliding face member 1 and the metal body 3 are then joined together by being heated in a vacuum at a temperature of 790°–880° C. for one hour to produce two kinds of tappets with target maximum crowning amounts of 15 $\mu$m and 40 $\mu$m, respectively. The overall length of the metal body is 40 mm. The metal body was carburized before being braze-joined. After joining, the outer peripheral portion 9 and the spherically recessed portion 10 at the inner bottom of the metal body were quenched by laser. A part of each tappet was further subjected to angular grinding by a diamond grinding wheel with the average abrasive grain size of 7–11 $\mu$m to improve the precision of the crowning contour. This component was assembled into a commercially available OHV diesel engine for commercial cars which was subjected to a durability test lasting 500 hours at revolution speeds of 1000 rpm using a used engine oil that was recovered after a car ran 100,000 km in a city. After the durability test, measurements were taken of the amount of wear (i.e., wear loss) on the cam face. The results are shown in Table 1. The contour accuracy of the crowning in Table 1 are the values obtained by performing calculation of the equation (1) on the crowning amount d at a $\phi$25-concentric circle with respect to the center line of the crowning, as shown in FIG. 7.

Figure 8A:
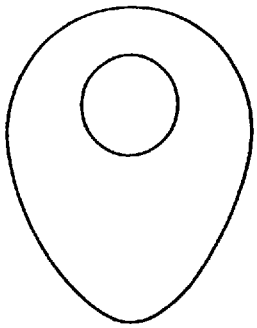
FIGS. 8A and 8B are schematic views showing the wear condition of the cam
Figure 8B:
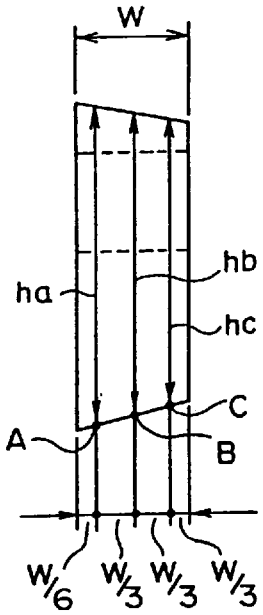

As criteria for the judgment of wear, the table presents the average wear losses in the heights Ha, Hb, Hc at three points A, B, C on the cam nose shown in FIG. 8 obtained by comparing the heights before and after the test [(ha+hb+hc)/3] (where ha, hb and hc represent the wear losses at the respective points) and deviations (difference between the maximum and the minimum of ha, hb and hc). FIG. 8A is a front view of the cam nose and 8B is a side view.

TABLE 1

Items marked with * are shown for comparison.

| No. | Sliding member | 3-point flexural strength (MPa) | Target max. crowning amount (μm) | Accuracy of axial symmetry of the crowing contour (%) | Grinding | Wear loss of cam nose (μm) Average wear loss | Deviation of wear loss |
|---|---|---|---|---|---|---|---|
| *1 | Silicon nitride | 1000 | 40 | 5 | Done | 10 | 2 |
| 2 | ↑ | ↑ | ↑ | 12 | ↑ | 10 | 2 |
| 3 | ↑ | ↑ | ↑ | 20 | ↑ | 10 | 2 |
| 4 | ↑ | ↑ | ↑ | 32 | Not done | 13 | 3 |
| 5 | ↑ | ↑ | ↑ | 45 | ↑ | 18 | 5 |
| *6 | ↑ | ↑ | ↑ | 58 | ↑ | 33 | 10 |
| *7 | Alumina | 637 | ↑ | Crack | — | — | — |
| *8 | Silicon carbide | 549 | ↑ | Crack | — | — | — |
| *9 | Zirconia | 1372 | ↑ | 5 | Done | 35 | 12 |
| *10 | ↑ | ↑ | ↑ | 30 | Not done | 45 | 20 |
| *11 | ↑ | ↑ | ↑ | 63 | Not done | 58 | 26 |
| *12 | Silicon nitride | 1372 | ↑ | 5 | Done | 6 | 1 |
| 13 | ↑ | ↑ | ↑ | 12 | ↑ | 6 | 1 |
| 14 | ↑ | ↑ | ↑ | 30 | Not done | 10 | 2 |
| *15 | ↑ | ↑ | ↑ | 65 | Not done | 30 | 8 |
| *16 | Silicon nitride | 1000 | 15 | 5 | Done | 15 | 3 |
| 17 | ↑ | ↑ | ↑ | 12 | ↑ | 15 | 3 |
| 18 | ↑ | ↑ | ↑ | 20 | ↑ | 16 | 4 |
| 19 | ↑ | ↑ | ↑ | 42 | Not done | 20 | 6 |
| *20 | ↑ | ↑ | ↑ | 54 | ↑ | 35 | 12 |
| *21 | Alumina | 637 | ↑ | 5 | Done | 22 | 5 |
| *22 | ↑ | ↑ | ↑ | 34 | Not done | 30 | 10 |
| *23 | Silicon carbide | 549 | ↑ | 5 | Done | 10 | 3 |
| *24 | ↑ | ↑ | ↑ | 44 | Not done | 22 | 6 |
| *25 | Silicon nitride | 1372 | ↑ | 5 | Done | 10 | 2 |
| 26 | ↑ | ↑ | ↑ | 12 | ↑ | 10 | 2 |
| 27 | ↑ | ↑ | ↑ | 33 | Not done | 15 | 3 |
| *28 | ↑ | ↑ | ↑ | 65 | ↑ | 28 | 8 |

NOTE:
In the above table, the word "crack" in the column of the accuracy of axial symmetry of the crowning contour means that a crack developed in the sliding member during the joining process. The cracked specimens therefore were not evaluated in the engine.

The test result found that the use of sliding member made of silicon nitride with a specified crowning precision can significantly minimize the wear loss and uneven or partial wear of the mating metal sliding component as compared with other ceramic members. It is also found that, among the silicon nitride-based materials, a material with an excellent strength characteristic can realize a further reduction in the wear loss and partial wear of the mating metal sliding component.

Example 2

Of the specimens shown in Table 1 of Example 1, Nos. 2, 4, 13, 14, 17, 19, 21, 23, 26 and 27 were subjected to the durability test lasting 100 hours at 6000 rpm, using the same engine as in Example 1. The result of wear evaluation, performed in the same way as in Example 1, is also shown in Table 2. As to whether cracks developed in the sliding member, a check was made every 10 hours during the 100-hour test to see if there was any crack. The times up to the occurrence of the cracks are shown in the table. Further, for the specimens that developed cracks, the wear loss before the crack occurred is also shown.

TABLE 2

Items marked with * are shown for comparison.

| No. | Crack | Wear loss of cam nose (μm) Average wear loss | Deviation of wear loss |
|---|---|---|---|
| 2 | Cracked after 90 hours | 25 | 8 |
| 4 | Cracked after 60 hours | 28 | 10 |
| 13 | None | 18 | 6 |
| 14 | None | 22 | 8 |
| 17 | None | 30 | 9 |
| 19 | None | 35 | 10 |
| *21 | Initial crack | — | — |
| *23 | Initial crack | — | — |
| 26 | None | 25 | 8 |
| 27 | None | 29 | 9 |

NOTE:
In the above table, "Initial crack" in the crack column indicates that the specimen in question was found to have already developed cracks the end of the first 10 hours. These specimens were therefore not evaluated for the wear.

From the above test result, it has been found that ceramic materials other than the silicon nitride-based material, when used for the sliding member, result in initial cracks in a high revolution range of engine and thus cannot be put to practical use. Of the silicon nitride-based materials, the material with an excellent strength characteristic is found not to produce cracks even in the high revolution range of the engine and is also found to reduce the wear loss and partial wear of the mating metal sliding component.

Example 3

Figure 9:
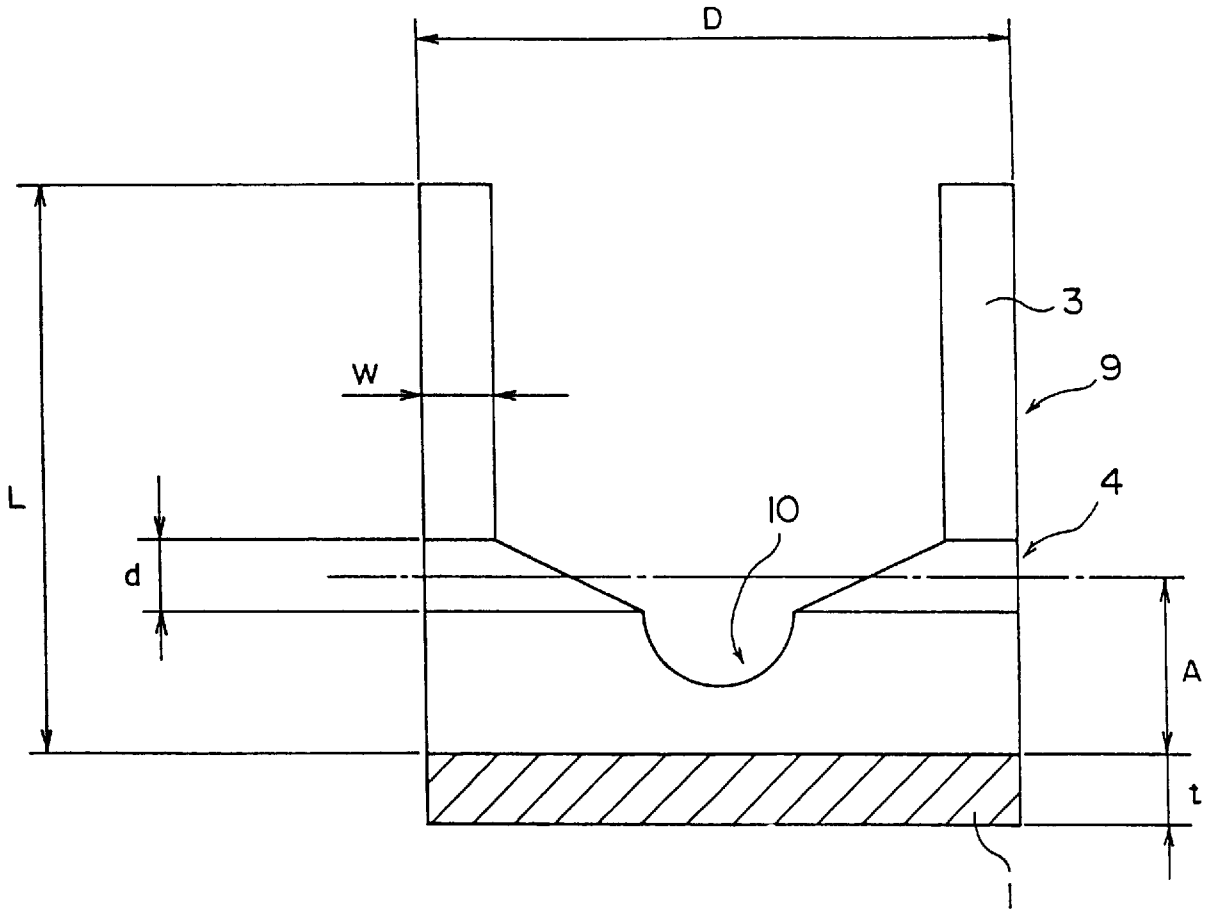
FIG. 9 is a schematic view (cross section) of the tappet applying this invention.

To a metal body 3 shown in FIG. 9 was brazed a commercially available silicon nitride 1 used in Example 1 at 870° C. in vacuum by using an Ag-Cu-Ti brazing material 0.05 mm thick to make a tappet. The major dimensions of the metal body 3 are shown in Table 3. The spherical recess 10 at the inner bottom is 14 mm in diameter for Nos. 29–48 and 9 mm for Nos. 49–57. The material used was SCM435 (JIS G4105).

The oil holes connecting the opening and the circumferential face were drilled at a distance A from the joined face of the metal body (the position A in Table 3 is a distance between the joined face of the metal body and the center line of the drilled oil hole), with the diameter and number of the holes changed.

The silicon nitride sliding face member 1 has the diameter 0.5 mm smaller than that of the metal body and the cam sliding face used was machined to the 10-point mean roughness of 0.3 μm or less.

After joining, the sliding portions of the metal body (the outer periphery portion and the spherically recessed portion at the inner bottom) were surface-quenched. In more concrete terms, the outer peripheral portion 9 was subjected to induction hardening and the inner bottom spherical recessed portion 10 was electron beam-hardened.

The measurements of the crowning were taken in the same way as in Example 1. The concentric circles used for crowning measurement, however, are ϕ25.8, 20.8 and 14.2 mm for the outer diameters ϕ31, 25 and 17 mm respectively. The amounts of crowning were 21–33 μm for Nos. 29–49 and 18–38 μm for Nos. 49–57. The results are shown in Table 3.

The specimens of Nos. 30, 31, 32, 33, 36 and 37 in the table were assembled into an OHV diesel engine for commercial car and subjected to a 200-hour durability test at an engine revolution of 1500 rpm using an engine oil that was taken from an engine after traveling 200,000 km in a city. The specimens of Nos. 31, 36 and 37 produced wear in excess of 50 μm on the outer periphery of the metal body. For Nos. 30, 32 and 33, the wear was 5 μm or less, and the wear of the cam nose, i.e., average wear loss and deviation set forth in Example 1, were 14 and 3 μm for Nos. 30, 12 and 3 μm for Nos. 32, and 10 and 2 μm for No. 33.

In No. 36, the diameter of the oil holes is very small and lubricant was not able to pass through the oil holes smoothly, resulting in the portions of the metal body in sliding contact with the engine block being worn out. However, the specimen No. 36, because this tappet is based on this invention, exhibited 10 and 2 μm for the average and deviation, respectively, of the cam nose wear, which are excellent characteristics when compared with those of the specimens outside the range of this invention. Specimen Nos. 31 and 37, although they have oil holes with larger diameters than those of No. 36, have fewer holes, so that the amount of lubricant supplied to the metal body was insufficient causing the similar wear to the foregoing comparative specimens.

TABLE 3

| | Oil hole | | Metal body | | | | | Sliding member | | | | | | | | |
|---|---|---|---|---|---|---|---|---|---|---|---|---|---|---|---|---|
| No. | Hole diameter (mm) d | Number n | Diameter (mm) D | Inner diameter (mm) din | Min. thickness (mm) W | Total length (mm) L | Hole position (mm) A | Thickness (mm) t | Flexural strength (MPa) | Axial symmetry accuracy of crowning contour (%) | Remarks | $d^2 \times n/D$ | $d^2 \times n/L$ | $d^2 \times n/W$ | $d^2 \times n/t$ | $d^2 \times n/A$ |
| +29 | 7.5 | 1 | 31 | 27 | 2 | 50.9 | 12.9 | 2.1 | 1000 | 63 | | 1.81 | 1.105 | 28.1 | 26.8 | 4.36 |
| 30 | 6 | 1 | 31 | 27 | 2 | 50.9 | 12.9 | 2.1 | ↑ | 44 | | 1.16 | 0.707 | 18.0 | 17.1 | 2.79 |
| +31 | 1.2 | 1 | 31 | 27 | 2 | 50.9 | 12.9 | 2.1 | ↑ | 6 | Wear occurred | 0.05 | 0.028 | 0.7 | 0.7 | 0.11 |
| 32 | 4.5 | 2 | 31 | 27 | 2 | 50.9 | 12.9 | 2.1 | ↑ | 31 | | 1.31 | 0.796 | 20.3 | 19.3 | 3.14 |
| 33 | 4.5 | 2 | 31 | 27 | 2 | 50.9 | 12.9 | 2.1 | 1372 | 30 | | 1.31 | 0.796 | 20.3 | 19.3 | 3.14 |
| +34 | 4.5 | 3 | 31 | 27 | 2 | 50.9 | 12.9 | 2.1 | 1000 | 61 | | 1.96 | 1.194 | 30.4 | 28.9 | 4.71 |
| +35 | 4.5 | 3 | 31 | 27 | 2 | 50.9 | 12.9 | 2.1 | 1372 | 62 | | 1.96 | 1.194 | 30.4 | 28.9 | 4.71 |
| 36 | 0.5 | 12 | 31 | 27 | 2 | 50.9 | 12.9 | 2.1 | 1000 | 11 | Wear occurred | 0.10 | 0.059 | 1.5 | 1.43 | 0.23 |
| +37 | 1 | 2 | 31 | 27 | 2 | 50.9 | 12.9 | 2.1 | ↑ | 8 | Wear occurred | 0.06 | 0.039 | 1.0 | 0.95 | 0.16 |
| 38 | 2 | 4 | 31 | 27 | 2 | 50.9 | 12.9 | 2.1 | ↑ | 19 | | 0.52 | 0.314 | 8.0 | 7.6 | 1.24 |
| 39 | 2 | 6 | 31 | 27 | 2 | 50.9 | 12.9 | 2.1 | ↑ | 35 | | 0.77 | 0.472 | 12.0 | 11.4 | 1.86 |
| 40 | 1 | 6 | 31 | 27 | 2 | 50.9 | 12.9 | 2.1 | ↑ | 12 | | 0.19 | 0.118 | 3.0 | 2.9 | 0.47 |
| 41 | 3 | 2 | 31 | 27 | 2 | 50.9 | 12.9 | 2.1 | ↑ | 22 | | 0.58 | 0.354 | 9.0 | 8.6 | 1.40 |
| +42 | 5.5 | 2 | 31 | 27 | 2 | 50.9 | 12.9 | 2.1 | ↑ | 59 | | 1.95 | 1.189 | 30.3 | 28.8 | 4.69 |
| +43 | 7 | 2 | 31 | 27 | 2 | 50.9 | 12.9 | 2.1 | ↑ | 73 | | 3.16 | 1.925 | 49.0 | 46.7 | 7.60 |
| +44 | 4.5 | 2 | 25 | 21 | 2 | 50.9 | 12.9 | 2.1 | ↑ | 62 | | 1.62 | 0.796 | 20.3 | 19.3 | 3.14 |
| +45 | 4.5 | 2 | 31 | 27 | 2 | 35 | 12.9 | 2.1 | ↑ | 58 | | 1.31 | 1.157 | 20.3 | 19.3 | 3.14 |
| +48 | 4.5 | 2 | 31 | 28 | 1.5 | 50.9 | 12.9 | 2.1 | ↑ | 55 | | 1.31 | 0.798 | 27.0 | 19.3 | 3.14 |
| +47 | 4.5 | 2 | 31 | 27 | 2 | 50.9 | 12.9 | 1.8 | ↑ | 73 | | 1.31 | 0.796 | 20.3 | 22.5 | 3.14 |
| +48 | 4.5 | 2 | 31 | 27 | 2 | 50.9 | 9 | 2.1 | ↑ | 69 | | 1.31 | 0.796 | 20.3 | 19.3 | 4.50 |
| 49 | 3.5 | 2 | 25 | 22 | 1.5 | 42.2 | 7.2 | 1.8 | ↑ | 29 | | 0.98 | 0.581 | 16.3 | 13.6 | 3.40 |
| 50 | 3 | 2 | 25 | 22 | 1.5 | 42.2 | 7.2 | 1.8 | ↑ | 18 | | 0.72 | 0.427 | 12.0 | 10.0 | 2.50 |
| 51 | 2 | 4 | 25 | 22 | 1.5 | 42.2 | 7.2 | 1.8 | ↑ | 15 | | 0.64 | 0.379 | 10.7 | 8.9 | 2.22 |

TABLE 3-continued

| | Oil hole | | Metal body | | | | | | | | | | | | | |
|---|---|---|---|---|---|---|---|---|---|---|---|---|---|---|---|---|
| | Hole | | Diam- | Inner diam- | Min. thick- | | Hole posi- | Sliding member | | Axial symmetry | | | | | | |
| No. | diam-eter (mm) d | Num-ber n | eter (mm) D | eter (mm) din | ness (mm) W | Total length (mm) L | tion (mm) A | Thick-ness (mm) t | Flexural strength (MPa) | accuracy of crowning contour (%) | Remarks | $d^2 \times n/D$ | $d^2 \times n/L$ | $d^2 \times n/W$ | $d^2 \times n/t$ | $d^2 \times n/A$ |
| 52 | 1.5 | 6 | 25 | 22 | 1.5 | 42.2 | 7.2 | 1.8 | ↑ | 10 | | 0.54 | 0.320 | 9.0 | 7.5 | 1.88 |
| +53 | 3.5 | 2 | 17 | 14 | 1.5 | 42.2 | 7.2 | 1.8 | ↑ | 64 | | 1.44 | 0.581 | 18.3 | 13.6 | 3.40 |
| +54 | 3.5 | 2 | 25 | 22 | 1.5 | 23 | 7.2 | 1.8 | ↑ | 60 | | 0.98 | 1.085 | 16.3 | 13.6 | 3.40 |
| +55 | 3.5 | 2 | 25 | 23.5 | 0.75 | 42.2 | 7.2 | 1.8 | ↑ | 57 | | 0.98 | 0.581 | 32.7 | 13.6 | 3.40 |
| +56 | 3.5 | 2 | 25 | 22 | 1.5 | 42.2 | 7.2 | 1.2 | ↑ | 78 | | 0.98 | 0.581 | 16.3 | 20.4 | 3.40 |
| +57 | 3.5 | 2 | 25 | 22 | 1.5 | 42.2 | 5 | 1.8 | ↑ | 65 | | 0.98 | 0.581 | 16.3 | 13.8 | 4.90 |

+: Example for comparison

Example 4

Figure 10:
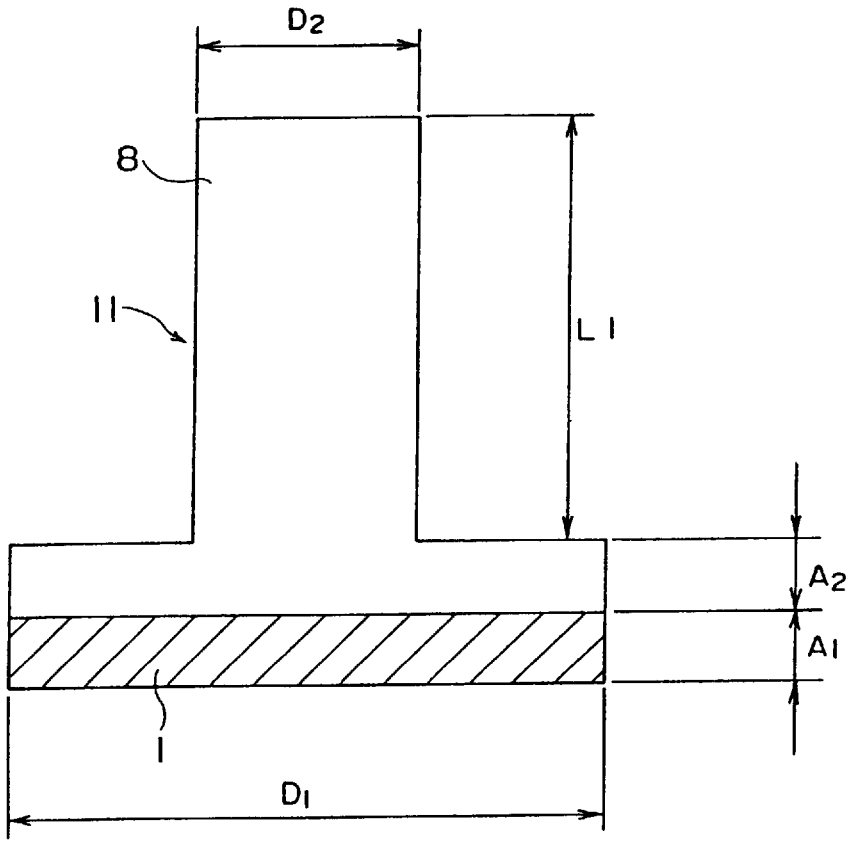
FIG. 10 is a schematic view (cross section) of the piston applying this invention.

To the metal body 8 shown in FIG. 10 was brazed at 950° C. in vacuum a commercially available silicon nitride used in Example 3 by using an Ag-Ti brazing material 0.07 mm thick to make a piston. The major dimensions of the metal body 8 are shown in Table 4. The material used is SCr440 (JIS 4101).

The silicon nitride has a diameter equal to that of the umbrella portion of the metal body. The cam sliding face was machined to the 10-point mean roughness of 0.3 $\mu$m or less.

After the joining, the outer peripheral portion 11 of the metal body, which was a sliding portion, was surface-hardened by radio-frequency heating.

Crowning was measured in the same way as in Example 1, and the concentric circles used for crowning measurement are $\phi$25, 22.5 and 10 mm for the umbrella portion diameters of $\phi$30, 27 and 12 mm, respectively. The amounts of crowning were 79–95 $\mu$m, 62–83 $\mu$m and 15–28 $\mu$m for the umbrella portion diameters of $\phi$30, 27 and 12 mm, respectively. The results are shown in Table 4.

Figure 11:
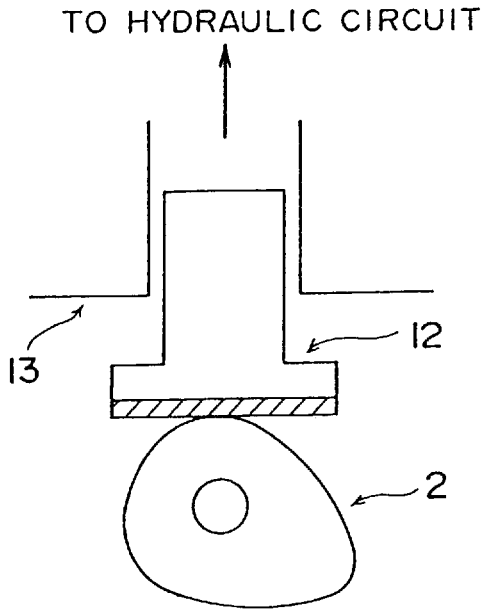
FIG. 11 is a schematic view showing the piston in operation.

The specimen Nos. 70–82 in the table were assembled into a commercially available in-line six-cylinder OHV diesel engine with a compression engine brake (displacement: 11000 cc; an engine oil used was taken from an engine after traveling 500,000 km in a city) and subjected to a test at an engine revolution of 2200 rpm. FIG. 11 shows a piston 12 assembled in the engine. The test result shows that specimen Nos. 70, 71 and 77–79, which were made of ceramics having a thickness of less than 1 mm, developed cracks in the silicon nitride immediately after the test, whereas specimen Nos. 72–76 and 80–82 produced no cracks in the silicon nitride even after the test and exhibited 8 and 2 $\mu$m for the average and deviation set forth in Example 1, respectively, of the cam nose wear.

TABLE 4

| | Metal body | | | | | | | | | | |
|---|---|---|---|---|---|---|---|---|---|---|---|
| | Slider portion | | Umbrella portion | | Sliding member | | Crowning | | | | |
| No. | Diameter (mm) D2 | Length (mm) L1 | Diameter (mm) D1 | Max. length (mm) A2 | Thickness 1 (mm) A1 | Flexural strength (MPa) | accuracy (%) | Remarks | D2/D1 | D2/A2 | L1/A2 |
| +58 | 12 | 26 | 30 | 2.4 | 1.7 | 1000 | 65 | | 0.400 | 5.00 | 10.83 |
| +59 | 14 | 26 | 30 | 2.4 | 1.7 | ↑ | 58 | | 0.467 | 5.83 | 10.83 |
| +60 | 14 | 26 | 30 | 2.4 | 1.7 | 1372 | 55 | | 0.467 | 5.83 | 10.83 |
| 61 | 16 | 26 | 30 | 2.4 | 1.7 | 1000 | 40 | | 0.533 | 6.67 | 10.83 |
| 62 | 16 | 26 | 30 | 2.4 | 1.7 | 1372 | 39 | | 0.533 | 6.67 | 10.83 |
| 63 | 18 | 26 | 30 | 2.4 | 1.7 | 1000 | 33 | | 0.600 | 7.50 | 10.83 |
| 64 | 20 | 26 | 30 | 2.4 | 1.7 | ↑ | 20 | | 0.667 | 8.33 | 10.83 |
| +65 | 12 | 26 | 27 | 2.4 | 1.7 | ↑ | 57 | | 0.444 | 5.00 | 10.83 |
| +66 | 14 | 26 | 27 | 2.4 | 1.7 | ↑ | 52 | | 0.519 | 5.83 | 10.83 |
| 67 | 16 | 26 | 27 | 2.4 | 1.7 | ↑ | 35 | | 0.593 | 6.67 | 10.83 |
| 68 | 18 | 26 | 27 | 2.4 | 1.7 | ↑ | 29 | | 0.667 | 7.50 | 10.83 |
| 69 | 20 | 26 | 27 | 2.4 | 1.7 | ↑ | 18 | | 0.741 | 8.33 | 10.83 |
| 70 | 18 | 26 | 30 | 2.4 | 0.6 | ↑ | 10 | Crack | 0.600 | 7.50 | 10.83 |
| 71 | 18 | 26 | 30 | 2.4 | 0.8 | ↑ | 13 | Crack | 0.600 | 7.50 | 10.83 |
| 72 | 18 | 26 | 30 | 2.4 | 1 | ↑ | 18 | | 0.600 | 7.50 | 10.83 |
| 73 | 18 | 26 | 30 | 2.4 | 1.2 | ↑ | 25 | | 0.600 | 7.50 | 10.83 |
| 74 | 18 | 26 | 30 | 2.4 | 1.4 | ↑ | 27 | | 0.600 | 7.50 | 10.83 |
| 75 | 18 | 26 | 30 | 2.4 | 1.6 | ↑ | 30 | | 0.600 | 7.50 | 10.83 |
| 76 | 18 | 26 | 30 | 2.4 | 2 | ↑ | 41 | | 0.600 | 7.50 | 10.83 |
| 77 | 10 | 20 | 12 | 1.5 | 0.5 | ↑ | 15 | Crack | 0.833 | 6.67 | 13.33 |
| 78 | 10 | 20 | 12 | 1.5 | 0.7 | ↑ | 17 | Crack | 0.833 | 6.67 | 13.33 |

TABLE 4-continued

| No. | Metal body: Slider portion: Diameter (mm) D2 | Length (mm) L1 | Umbrella portion: Diameter (mm) D1 | Max. length (mm) A2 | Sliding member: Thickness 1 (mm) A1 | Flexural strength (MPa) | Crowning accuracy (%) | Remarks | D2/D1 | D2/A2 | L1/A2 |
|---|---|---|---|---|---|---|---|---|---|---|---|
| 79 | 10 | 20 | 12 | 1.5 | 0.9 | ↑ | 21 | Crack | 0.833 | 6.67 | 13.33 |
| 80 | 10 | 20 | 12 | 1.5 | 1.1 | ↑ | 26 | | 0.833 | 6.67 | 13.33 |
| 81 | 10 | 20 | 12 | 1.5 | 1.3 | ↑ | 28 | | 0.833 | 6.67 | 13.33 |
| 82 | 10 | 20 | 12 | 1.5 | 1.5 | ↑ | 31 | | 0.833 | 6.67 | 13.33 |
| +83 | 16 | 20 | 30 | 2.4 | 1.7 | ↑ | 57 | | 0.533 | 6.67 | 8.33 |
| +84 | 16 | 15 | 30 | 2.4 | 1.7 | ↑ | 71 | | 0.533 | 6.67 | 6.25 |
| +85 | 10 | 12 | 12 | 1.5 | 1.5 | ↑ | 60 | | 0.833 | 6.67 | 8.00 |
| +86 | 10 | 8 | 12 | 1.5 | 1.5 | ↑ | 81 | | 0.833 | 6.67 | 5.33 |

+: Example for comparison

Example 5

Figure 12:
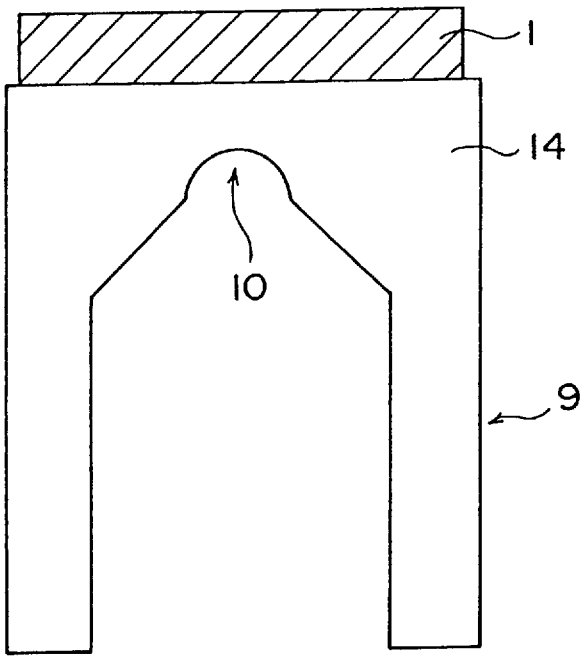
FIG. 12 is a schematic view (cross section) of the tappet applying this invention.

FIG. 12 shows a manufactured tappet.

The sliding face member 1 was made by machining a silicon nitride material 1, which was available on the market and same as used in Example 3, to a plate of 29.5 mm in diameter and 2 mm in thick and polishing the cam sliding face to the 10-point mean roughness of 0.3 $\mu$m or less.

Figure 13B:
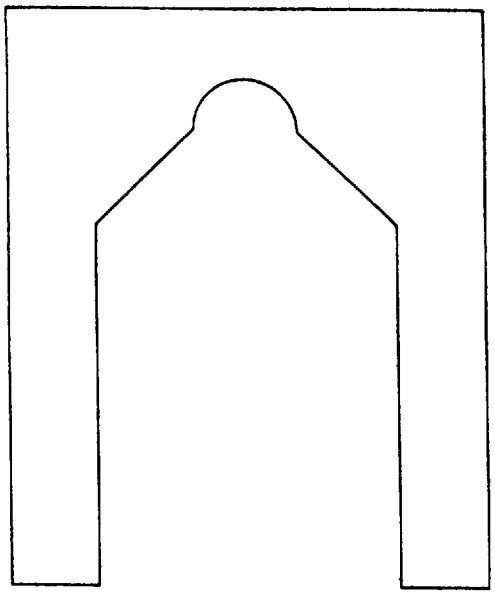
FIGS. 13A and 13B are schematic views of the metal body in Example 5.
Figure 13A:
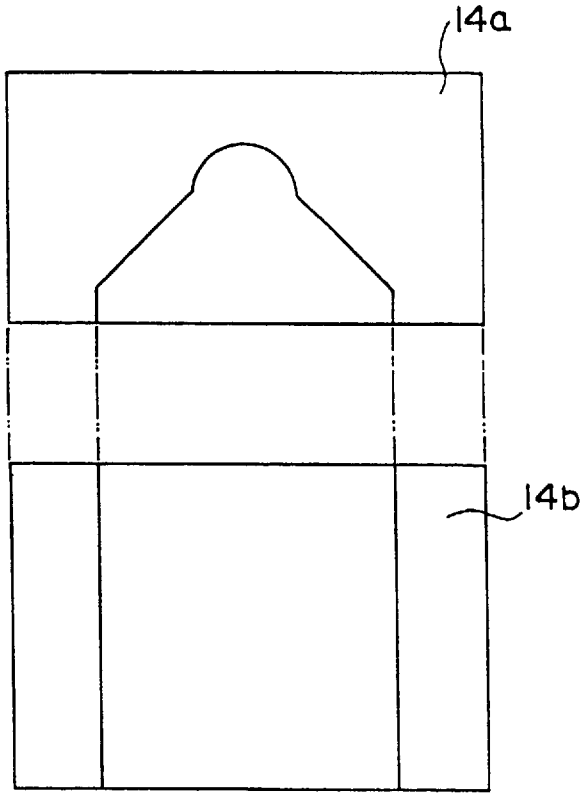

The metal body 14 was made in three kinds:

(1) Two pieces, an upper half 14*a* and a lower half 14*b* were fabricated in a shape as shown in FIG. 13A, and then joined together, after which they were joined with the sliding face member 1.

(2) Two pieces, an upper half 14*a* and a lower half 14*b* were fabricated in a shape as shown in FIG. 13A, and the sliding face member 1 was joined, after which the upper and lower halves were joined together.

(3) One-piece metal body was fabricated as shown in FIG. 13B.

For (1) and (2), the upper half 14*a* and the lower half 14*b* were made of different materials in one case and of the same materials in another case. A variety of materials were used in combination. The metal body 14 has the diameter of 30 mm, the opening diameter of 26 mm and the total length of 39 mm. Detailed dimensions are shown in Table 5.

The joining of the metal body was done as shown in Table 5.

The silicon nitride plate and the upper half of the steel body 14*a* were brazed together with an Ag-Cu-Ti brazing material 0.06 mm thick at 850° C. in vacuum.

As to the specimen Nos. 87–89, 91, 93–95, 98 and 100, when they are fabricated into a tappet shape, the sliding portions (9, 10) were induction-hardened, after which they were assembled into an OHV diesel engine for commercial car and subjected to a 200-hour durability test at an engine revolution of 3000 rpm using an engine oil taken from an engine after traveling 100,000 km in a city.

For Nos. 90, 97, 99 and 101, the induction hardening was not done because the steel was hardened during cooling in the process of brazing.

For Nos. 92 and 96, the upper half 14*a* used the same steel material as No. 90 and was quenched during brazing, after which it was joined with the lower half 14*b* that was already quenched.

Measurements of crowning of each sample were made in the same way as in Example 3. The concentric circle used for crowning measurements was $\phi$25. The accuracies of the crownings are shown in Table 5. The amounts of crownings were 15–32 $\mu$m.

The result of the durability test shows that for the Nos. 87–97 consisting of joined metal body halves, the averages of cam nose wear described in Example 1 all exceeded 50 $\mu$m, the level of wear that poses a problem for practical use. For Nos. 98–101 that were single-piece structures and used the single same material, the wear was 9–18 $\mu$m, less than half the previous sample group.

These results show that the tappet of this invention made of a single material without any division of the metal body exhibits an excellent durability.

The word "carburized" in the table indicates that the divided body halves were carburized and then quenched. "Quenched material" in the table means that the divided body halves were oil-quenched.

TABLE 5

| No. | Division of metal body | Material: Upper half | Lower half | Joining of metal body | Method of joining metal body | Crowning accuracy (%) |
|---|---|---|---|---|---|---|
| +87 | Divided | SCr440 | SCr440 | Before brazing ceramic | Electron beam welding | 61 |
| +88 | Divided | SNC836 | SCM836 | Before brazing ceramic | Laser welding | 57 |
| +89 | Divided | SNC836 | SCM836 | After brazing ceramic | Laser welding | 54 |
| +90 | Divided | SNCM6 30 | SNCM630 | Before brazing ceramic | Friction pressure welding | 52 |
| +91 | Divided | SCM435 | S48C | After brazing ceramic | Laser welding | 65 |
| +92 | Divided | SNCM630 | SCM418 (carburized) | After brazing ceramic | Electron beam welding | 55 |
| +93 | Divided | SCr440 | SCr445 | Before brazing ceramic | Laser welding | 58 |
| +94 | Divided | SCr440 | SCr445 | After brazing ceramic | Laser welding | 60 |
| +95 | Divided | SCr420 (carburized) | S55C | Before brazing ceramic | Laser welding | 69 |
| +96 | Divided | SNCM630 | S45C (quenched material) | After brazing ceramic | Electron beam welding | 59 |

TABLE 5-continued

| No. | Division of metal body | Material: Upper half | Material: Lower half | Joining of metal body | Method of joining metal body | Crowning accuracy (%) |
|---|---|---|---|---|---|---|
| +97 | Divided | SNCM616 (carburized) | SNCM616 (carburized) | Before brazing ceramic | Electron beam welding | 66 |
| 98 | Not divided | SCr440 | — | — | — | 20 |
| 99 | Not divided | SNCM630 | — | — | — | 13 |
| 100 | Not divided | S48C | — | — | — | 33 |
| 101 | Not divided | SNCM616 (carburized) | — | — | — | 33 |

+: Example for comparison

INDUSTRIAL APPLICABILITY

As described above, this invention uses a silicon nitride material for the sliding face member and has a specified precision of a crowning contour. This prevents abnormal wear and partial wear of the mating metal sliding part even when an oil contaminated with exhaust gas components is used.

We claim:

1. A ceramic sliding component comprising: a sliding face member made of a silicon nitride material and having a sliding face; a metal body having a higher thermal expansion coefficient than the sliding face member, the metal body and the sliding face member being joined together, and a crowning portion formed on the sliding face of the sliding face member;

wherein the difference in the amount of crowning between two arbitrary points axially symmetric with respect to the center of the crowned portion is 10% or more and 50% or less of the average crowning amount at the two points and wherein a value $d^2 \times n/D$ falls in a range between 0.07 and 1.4, i.e., $d^2 \times n/D=0.07$ to 1.4, where d is a diameter of oil holes drilled in the metal body to circulate a lubricant and connect a body interior and a body exterior, n is the number of oil holes, and D is a diameter of the metal body.

2. A ceramic sliding component according to claim 1, wherein the structure (rigidity) of the metal body is symmetric two or more times with respect to a diametric direction of the sliding face.

3. A ceramic sliding component according to claim 2, wherein the metal body is formed with two or more oil holes that circulate a lubricant and connect the body interior with the body exterior.

4. A ceramic sliding component according to claim 1, wherein the whole metal body is made of a single, unjoined material.

5. A ceramic sliding component comprising: a sliding face member made of a silicon nitride material and having a sliding face; a metal body having a higher thermal expansion coefficient than the sliding face member, the metal body and the sliding face member being joined together, and a crowned portion formed on the sliding face of the sliding face member;

wherein the difference in the amount of crowning between two arbitrary points axially symmetric with respect to the center of the crowned portion is 10% or more and 50% or less of the average crowning amount at the two points and wherein a value $d^2 \times n/L$ falls in a range between 0.05 and 1.05, i.e., $d^2 \times n/L=0.05$ to 1.05, where d is a diameter of oil holes drilled in the metal body to circulate a lubricant and connect a body interior and a body exterior, n is the number of oil holes, and L is a total length of the metal body.

6. A ceramic sliding component according to claim 5 wherein the structure (rigidity) of the metal body is symmetric two or more times with respect to a diametric direction of the sliding face.

7. A ceramic sliding component according to claim 6, wherein the metal body is formed with two or more oil holes that circulate a lubricant and connect the body interior with the body exterior.

8. A ceramic sliding component according to claim 5 wherein the whole metal body is made of a single, unjoined material.

9. A ceramic sliding component comprising: a sliding face member made of a silicon nitride material and having a sliding face; a metal body having a higher thermal expansion coefficient than the sliding face member, the metal body and the sliding face member being joined together, and a crowned portion formed on the sliding face of the sliding face member;

wherein the difference in the amount of crowning between two arbitrary points axially symmetric with respect to the center of the crowned portion is 10% or more and 50% or less of the average crowning amount at the two points and wherein a value $d^2 \times n/W$ falls in a range between 1.3 and 26, i.e., $d^2 \times n/W=1.3$ to 26, where d is a diameter of oil holes drilled in the metal body to circulate a lubricant and connect a body interior and a body exterior, n is the number of oil holes, and W is a minimum thickness of the metal body where the oil holes are formed.

10. A ceramic sliding component according to claim 9 wherein the structure (rigidity) of the metal body is symmetric two or more times with respect to a diametric direction of the sliding face.

11. A ceramic sliding component according to claim 10, wherein the metal body is formed with two or more oil holes that circulate a lubricant and connect the body interior with the body exterior.

12. A ceramic sliding component according to claim 9, wherein the whole metal body is made of a single, unjoined material.

13. A ceramic sliding component comprising: a sliding face member made of a silicon nitride material and having a sliding face; a metal body having a higher thermal expansion coefficient than the sliding face member, the metal body and the sliding face member being joined together, and a crowned portion formed on the sliding face of the sliding face member;

wherein the difference in the amount of crowning between two arbitrary points axially symmetric with respect to the center of the crowned portion is 10% or more and 50% or less of the average crowning amount at the two points and wherein a value $d^2 \times n/t$ falls in a range between 1 and 20, i.e., $d^2 \times n/t=1$ to 20, where d is a diameter of oil holes drilled in the metal body to circulate a lubricant and connect a body interior and a body exterior, n is the number of oil holes, and t is a thickness of the sliding member joined to the metal body.

14. A ceramic sliding component according to claim 13 wherein the structure (rigidity) of the metal body is symmetric two or more times with respect to a diametric direction of the sliding face.

15. A ceramic sliding component according to claim 14, wherein the metal body is formed with two or more oil holes that circulate a lubricant and connect the body interior with the body exterior.

16. A ceramic sliding component according to claim 13, wherein the whole metal body is made of a single, unjoined material.

17. A ceramic sliding component comprising: a sliding face member made of a silicon nitride material and having a sliding face; a metal body having a higher thermal expansion coefficient than the sliding face member, the metal body and the sliding face member being joined together, and a crowned portion formed on the sliding face of the sliding face member;

wherein the difference in the amount of crowning between two arbitrary points axially symmetric with respect to the center of the crowned portion is 10% or more and 50% or less of the average crowning amount at the two points and wherein a value $d^2 \times n/A$ falls in a range between 0.2 and 4.2, i.e, $d^2 \times n/A = 0.2$ and 4.2, where d is a diameter of oil holes drilled in the metal body to circulate a lubricant and connect a body interior with a body exterior, n is the number of oil holes, and A is a distance from the joined face of the metal body to the center of the oil holes.

18. A ceramic sliding component according to claim 17 wherein the structure (rigidity) of the metal body is symmetric two or more times with respect to a diametric direction of the sliding face.

19. A ceramic sliding component according to claim 18, wherein the metal body is formed with two or more oil holes that circulate a lubricant and connect the body interior with the body exterior.

20. A ceramic sliding component according to claim 17, wherein the whole metal body is made of a single, unjoined material.

21. A ceramic sliding component comprising: a sliding face member made of a silicon nitride material and having a sliding face; a metal body having a higher thermal expansion coefficient than the sliding face member, the metal body and the sliding face member being joined together; and a crowned portion formed on the sliding face of the sliding face member;

wherein the difference in the amount of crowning between two arbitrary points axially symmetric with respect to the center of the crowned portion is 10% or more and 50% or less of the average crowning amount at the two points, wherein the metal body has a slider portion in sliding contact with an engine block and an umbrella portion formed at one end of the slider portion, the umbrella portion is joined with the sliding face member, a dimensional ration D2/D1 between a diameter (D2) of the slider portion of the metal body and a diameter (D1) of the umbrella portion is set at 0.5 or higher, and a dimensional ratio D2/A2 between the slider portion diameter (D2) and a maximum thickness ○ the umbrella portion (A2) is set at 6.5 or higher.

22. A ceramic sliding component according to claim 21, wherein a length of the slider portion (L1) is 10 or more times the maximum thickness of the umbrella portion (A2).

23. A ceramic sliding component according to claim 21, wherein a thickness (A1) of the sliding face member is 1 mm or more.

* * * * *